United States Patent [19]

Hemans

[11] Patent Number: 4,958,871

[45] Date of Patent: Sep. 25, 1990

[54] HAND TOOL FOR PICKING UP ANIMAL DROPPINGS

[76] Inventor: James W. Hemans, 10124 53rd Ave. West, Everett, Wash. 98204

[21] Appl. No.: 339,309

[22] Filed: Apr. 17, 1989

[51] Int. Cl.[5] ..... A01K 29/00; E01H 1/12

[52] U.S. Cl. ..... 294/1.4; 15/257.1; 294/55

[58] Field of Search ..... 294/1.1, 1.3–1.5, 294/19.1, 55; 15/104.8, 257.1, 257.2, 257.4, 257.7; 141/108, 109, 391; 248/95, 99, 100

[56] References Cited

U.S. PATENT DOCUMENTS

| | | | |
|---|---|---|---|
| 3,281,178 | 10/1966 | Fisher | 294/1.4 |
| 3,688,483 | 9/1972 | Hamilton | 294/1.4 |
| 3,754,785 | 8/1973 | Anderson | 294/1.4 X |
| 4,012,067 | 3/1977 | Travis | 294/1.4 |
| 4,021,994 | 5/1977 | Mainprice | 294/1.4 |
| 4,047,746 | 9/1977 | Radowski | 294/1.4 |
| 4,121,866 | 10/1978 | Schall et al. | 294/1.4 |
| 4,146,259 | 3/1979 | Schultz | 294/1.4 |
| 4,191,414 | 3/1980 | Dameron | 294/1.4 |
| 4,705,310 | 11/1987 | Scripter | 294/1.4 |

*Primary Examiner*—Johnny D. Cherry

[57] ABSTRACT

An improved, hand-held device for the picking up of animal waste in a clean, hygenic manner using a scooping device (#26) and a fold-lock-top sandwich bag as the receptacle for the waste material is the embodiment of this invention. The large pocket (#14) of the fold-lock-top sandwich bag fits through a central opening in the scoop device while the small pocket (#22) of the same bag completely covers the scooping-type tapered blade (#28) so as to prevent any soiling of the scoop device (#26) by the waste material. This scoop device (#26) is attached to a locking telescopic handle with an adjustable belt clip (#8) so as to allow freedom of the hands while in transport. By using a fast forward motion, with the wrist, the animal waste is lifted slightly by the tapered blade (#28) and deposited in the large pocket (#14) of the very common, inexpensive fold-lock-top sandwich bag used as its receptacle. The bag is easily removed by lifting the flap (#18) of the fold-lock-top bag off the hook (#16) which is used to keep the bag open while in use. The scoop device (#26) itself never gets dirty.

5 Claims, 2 Drawing Sheets

FIG. 1
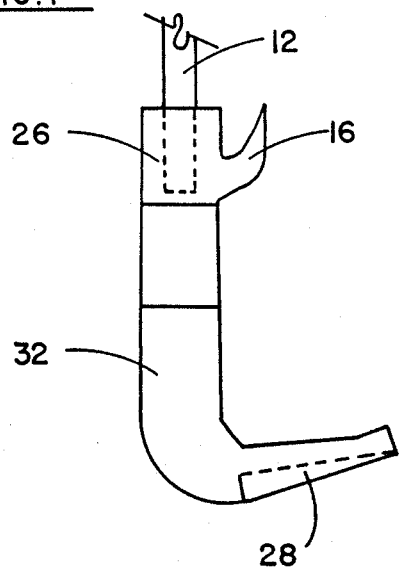
FIG. 2
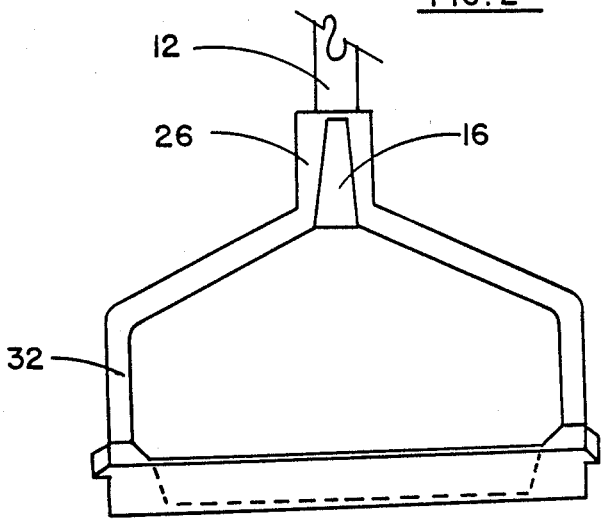
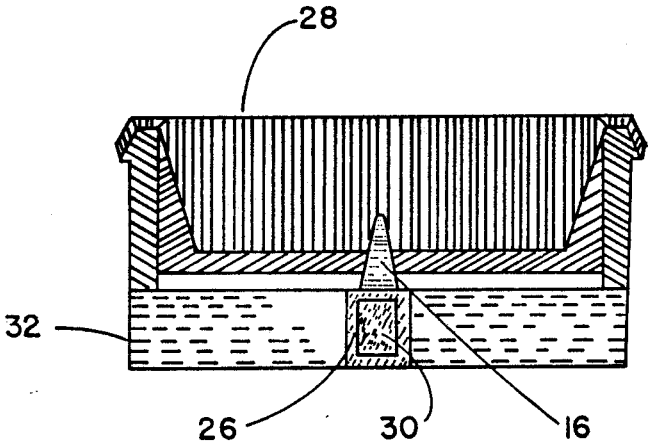
FIG. 3

HAND TOOL FOR PICKING UP ANIMAL DROPPINGS

FIELD OF THE INVENTION

This invention relates to hand operated tools using a sanitary method for picking up animal droppings.

BACKGROUND—PRIOR ART

Heretofore, sanitary pet scoops were designed mostly to be used by both hands at the same time. These scoop devices consist of metal or plastic parts which come together forcing the animal droppings into one or both scoop shaped parts. Both parts become badly soiled by the animal droppings.

Many of these scooping devices consist of two long handles fastened approximately half way down the handle shafts. These handles operate with a scissors type movement requiring both hands. On the lower end of these handles are scoop devices which come together as the handles are moved together, gathering the animal waste between the two scoop devices.

Another type on the market has two separate handles, one having a blade or rake device on the lower end and the other a scoop type receptacle. These are moved together in such a way as to gather up the waste material in the receptacle by pushing the waste material with the blade or rake device.

Both of these types of scooping devices have many disadvantages:

1. These devices become heavily soiled upon use.
2. These devices are very cumbersome to carry due to their long handles and require constant use of at least one hand, both before and after their use.
3. Extensive cleaning is required after each use of these types of scooping devices.
4. Having hands occupied by these devices permits little interaction between the owner and pet.
5. Storage is also a problem due to the size of the scoop devices and the cleanliness after their use.
6. Most of these types of scoop devices are very costly.

Another type of scoop consists of a metal hoop over which fits specially designed plastic bags. The main disadvantages to this type of scoop are:

1. Lack of access to the special bag.
2. The constant use of a hand to carry the device.
3. Soiling of the device.
4. The added cost of the special bag.

A few disposable type scoops exist. These require bending over during use, thus getting very close to the animal waste itself. In addition, these types of scoops are very costly and require carrying of the waste material in close proximity to the hand until disposal and permit one-time use only.

Considering the many disadvantages of these scooping devices, it is no surprise that most pet owners fail to adequately use these pet waste hygiene devices.

SUMMARY

Several objectives and advantages of my invention are:

1. The use of a very inexpensive fold-lock-top sandwich bag available in most food stores, as the receptacle for the animal waste.
2. The use of a telescopic handle for easier storage and usage.

3. The use of an adjustable belt clip on the handle which allows one to carry this scoop device without using hands.
4. The use of plastic in the handle and scoop sections for strength, looks, and cleanliness.
5. The use of a blade-like scoop which is totally covered by the fold-lock-top sandwich bag allowing for easy waste pickup without soiling the scoop.
6. The use of a telescopic handle allows easy one-handed operation well away from the animal waste.
7. The use of a fastener for the flap portion of the fold-lock-top sandwich bag keeps the bag open while allowing its easy removal by simply pulling the flap off of the fastener and lifting the bag filled with debris from the scoop device.
8. The per-use cost of this scoop is very low due to the availability of low cost fold-top-bags.
9. Still further objectives and advantages will become apparent from a consideration of the ensuing description and drawings and also from the use of the invention by the pet owner and others.

BRIEF DESCRIPTION OF DRAWINGS

This hand-held scoop device is illustrated in the accompanying drawings, wherein:

FIG. 1 shows a side view of the scoop device illustrating the hook for bag flap attachment and the angle of attachment of the scoop blade.

FIG. 2 shows a front view of the scoop device with the rectangular space through which the large pocket of the fold-top sandwich bag fits and also shows the hook and scooping blade.

FIG. 3 shows the top view of the scoop device with the scooping blade, hook, and aperture for handle attachment.

Reference Numerals On Drawings

Figure 4:
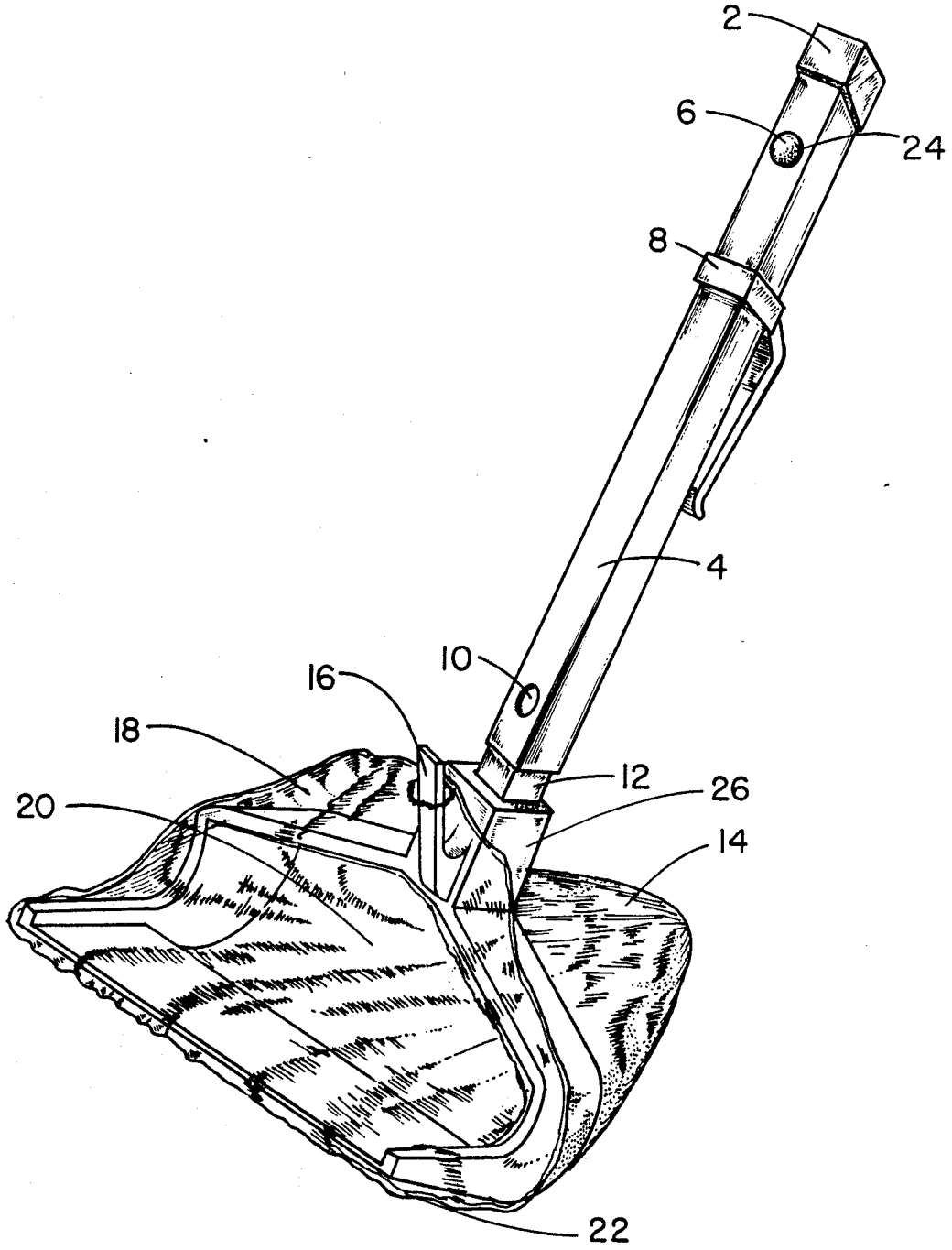
FIG. 4 is an overall perspective view of the scoop device with telescopic handle, belt clip, and fold-lock-top sandwich bag attached, illustrating how the scoop device is protected by the sandwich bag flap.

2—handle end cap
4—upper handle section
6—spring-loaded button
8—adjustable belt clip
10—lower button hole
12—lower handle section
14—large pocket of bag
16—hook
18—flap of bag
20—opening of bag
22—small pocket of bag
24—upper button hole
26—scoop device
28—tapered blade
30—apperture
32—blade support arms

DESCRIPTION OF THE PREFERRED EMBODIMENT

A typical embodiment of the present invention is shown in FIG. 1 (side view) and FIG. 2 (front view) and FIG. 3 (top view). This scoop device (#26) is typically made of a dense plastic compound and is approximately 90 mm in height with a blade (#28) approximately 130 mm in length and 30 mm in width, supported by two blade support arms (#32), approximately 13 mm wide and 3 mm thick, attached to the ends of the blade (#28) and also forming a generally rectangular shaped opening between the two blade support arms (#32), the blade itself (#28) and the hook (#16) attachment as shown in FIG. 2. The blade (#28) portion between the two blade support arms (#32) is typically sloped from the front, thinner, edge approximately 5 mm thick as shown in FIGS. 1, 2, and 3. The hook (#16) is attached where the upper sections of the blade support arms (#32) join together with the hook (#16) pointing up, away from the blade (#28). The hook (#16) is approximately 30 mm in length and tapers upward (FIG. 1). In the top portion of the scoop device (#26) is an aperture (#30) into which the lower handle section (#12) is attached (FIGS. 3 and 4).

In FIG. 4, a drawing shows the scoop device (#26) attached to a lower handle section (#12) covered over by an upper handle section (#4), attached by a spring-loaded button (#6) protruding through the upper button hole (#24) on the upper handle section (#4). This figure represents the handle in the collapsed position. In the telescoped position, the spring-loaded button (#6) would be protruding through the lower button hole (#10) in the upper handle section (#4).

On the upper handle section (#4) is an adjustable belt clip (#8) which can be moved up or down the upper handle section (#4) for convenience in carrying the scoop device (#26) as shown in FIG. 4. On the upper end, cap (#2) prevents foreign material from entering the handle sections and also aids with the gripping of the upper handle section.

The manner of operation of this scoop device (#26), as represented in FIG. 4, begins with the removal of the entire unit from a belt to which it is attached by the adjustable belt clip (#8).

After lifting the scoop device (#26) from a belt, a fold-lock-top sandwich bag is installed on the scoop device (#26) by inserting the blade (#28) into the small pocket (#22) of the bag in the manner described as follows:

Place one hand into the large pocket of the fold-lock-top sandwich bag with the small pocket (#22) of the fold-lock-top sandwich bag laying across the palm of hand. Insert the large pocket (#14) of the fold-lock-top sandwich bag into the rectangular shaped opening of the scoop device (#26) with the thinner edge of the tapered blade (#28) on the same side of, and moving toward, the palm of the first hand and having the tapered blade (#28) enter into the small pocket (#22) of the fold-lock-top sandwich bag, being certain the tapered blade (#28) is fully enclosed by the small pocket (#22) of the fold-lock-top sandwich bag.

While holding the small pocket (#22) of the fold-lock-top sandwich bag on the tapered blade (#28) with the second hand, remove the first hand from inside the large pocket (#14) of the fold-lock-top bag and grasp the flap (#18) of the bag and stretch it lightly up and over and onto the hook (#16). This helps secure the fold-lock-top bag onto the scoop device along with the covering by the small pocket (#22) of the bag of the tapered blade (#28).

With the fold-lock-top sandwich bag attached to the scoop device (#26), extend the handle by grasping the upper handle section (#4) and, while depressing the spring-loaded button (#6) with the thumb of the same hand, pull slowly away with the other hand by grasping the scoop device (#26) and moving the hands in opposite directions until the spring-loaded button pops into place through the lower button hole (#10) on the upper handle section (#4). This secures the handle sections in a rigid, extended position ready for use.

To scoop up waste material, place the scoop device (#26) behind refuse with the bottom portion of the, now covered, tapered blade (#28) on the ground surface. Have the large opening (#20) of the fold-lock-top sandwich bag facing toward waste material. Move the scoop device rapidly toward the waste material with a quick wrist action while keeping the tapered blade (#28) rubbing lightly on, and parallel to, the ground surface by applying a slight downward pressure. This rapid motion, along with the tapered blade design, causes the debris to be lifted up slightly and deposited into the large pocket of the fold-lock-top sandwich bag (#14).

To remove the fold-lock-top bag containing the waste material, simply lift the flap (#18) of the bag up off the hook (#16) and, while holding onto the flap (#18), lift the bag filled with waste up and off the scoop device (#26).

The fold-lock-top sandwich bag slides up and off the tapered blade (#28) in the reverse manner of installation.

I claim:

1. In combination, a hand operated device for picking up animal feces that includes a plastic, telescoping, locking, two-piece, square in cross-section handle and, rigidly affixed to one end of said handle, a plastic scooping device consisting of a horizontally positioned, solid plastic, tapered in height cross section, blade attached at both ends by vertically positioned supports from the ends of said horizontally positioned blade, providing a means for a central opening between said blade and vertical supports and the end of the handle to which said vertical supports are attached, so a plastic fold-lock-top sandwich bag, consisting of a smaller pocket attached on the opposite side of a larger pocket with a flap attached which is as wide as the larger pocket opening, fits its' larger pocket through said central opening in said scooping device acting as a means for a receptacle for the animal feces, 2. A device as set in claim 1, wherein said horizontally positioned, solid plastic, tapered in height cross-section blade, upon said scooping device, is totally covered by the smaller pocket of said fold-lock-top sandwich bag so as to prevent soiling of said blade by the animal feces, 3. In combination with claim 1, where said scooping device is rigidly attached to said handle, wherein a single hook type holding device parallel to and elevated off of the handle by attachment to the scoop device at one end with an open end of said hook type holding device facing up away from the scoop device but on the same side as the tapered blade, exists as a means of securing the flap of the fold-lock-top sandwich bag in such a manner as to provide a means of keeping open the fold-lock-top sandwich bag as a refuse receptacle in said central opening of the scoop device.

4. A device as set forth in claim 1, wherein a plastic adjustable belt clip is attached to the telescopic handle so that it may be positioned anywhere on the handle to facilitate its carrying from one place to another without the use of hands.

5. A device as set forth in claim 1, wherein a handle end cap is attached to the handle to facilitate gripping and to prevent the adjustable belt clip from coming off the top end of the handle.

* * * * *